United States Patent [19]

Wilger et al.

[11] 4,383,395

[45] May 17, 1983

[54] IN-PLACE ROTATING GRINDING MACHINE

[75] Inventors: John F. Wilger, Honolulu; Gregory S. Nakano, Pearl City; Stephen Orillo, Jr.; Alfred Medrano, both of Mililani Town; Billy D. Sears, Waipahu; Tadao Uyetake, Honolulu, all of Hi.

[73] Assignee: The United States of America as represented by the Secretary of the Navy, Washington, D.C.

[21] Appl. No.: 275,551

[22] Filed: Jun. 19, 1981

[51] Int. Cl.[3] ..... B24B 5/40

[52] U.S. Cl. ..... 51/245; 51/135 R; 409/143

[58] Field of Search ..... 51/245, 241 R, 241 S, 51/261, 135 R, 170 EB; 409/139, 140, 143; 15/104.09, 104.12

[56] References Cited

U.S. PATENT DOCUMENTS

| | | | |
|---|---|---|---|
| 1,365,149 | 1/1921 | Breed | 51/245 |
| 2,931,146 | 4/1960 | Handwerk et al. | 51/241 R |
| 4,327,526 | 5/1982 | Pettyjohn et al. | 51/245 |

*Primary Examiner*—James L. Jones, Jr.
*Assistant Examiner*—Douglas D. Watts
*Attorney, Agent, or Firm*—Robert F. Beers; Ervin F. Johnston; Terrance A. Meador

[57] ABSTRACT

An apparatus for in-place grinding of the inner surface of huge cylinders comprises two adjustable spider ring assemblies which support a rotating rail assembly. A cage assembly is mounted on and rotates with the rail assembly and carries a grinding unit for grinding the inner surface of the cylinder.

6 Claims, 28 Drawing Figures

IN-PLACE ROTATING GRINDING MACHINE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Submarine torpedo ejection pumps include long, large diameter cylinders through which a piston travels, to eject torpedos during launch. When a submarine comes into a shipyard for periodic overhaul, the ejection pump cylinders are inspected and repaired to maintain their maximum functional efficiency. The cylinders are inspected for roundness and straightness and repaired as required to conform to specified geometric tolerances. Periodic maintenance is essential to prevent the piston from binding in the cylinder. Because the cylinder is welded into the structure of the submarine, it is not possible to remove it from the ship for repairs. Making the need clear for an apparatus which can be used on site at a shipyard for machining the interior surfaces of defective torpedo ejection cylinders.

SUMMARY OF THE INVENTION

The disclosed invention is a grinding apparatus for in-place machining of the interior surface of a large hollow cylinder. The grinding apparatus comprises two circumferentially adjustable spider ring assemblies which are concentrically attachable, in a spaced relationship, to the inner surface of the cylinder. A longitudinal annulate rail assembly having opposite ends is supported by the ring assemblies with each end of the rail assembly rotatably mounted in a spider ring assembly so that the rail assembly can be coaxially positioned in the cylinder and rotated. A drive means mounted on at least one spider ring is provided for rotating the rail assembly. A cage assembly is slidably mounted on and rotates with the rail assembly and a grinding assembly is, in turn, mounted on the cage assembly. As the rail and cage assemblies rotate, the grinding assembly grinds the cylinder's inner surface.

OBJECTS OF THE INVENTION

It is an object of the present invention to provide a grinding apparatus for in-place machining of the interior surface of a hollow cylinder.

It is a further object of the invention to provide a rail assembly for an in-place grinding apparatus where the grinding operation is accomplished by rotating the rail assembly with a grinder mounted thereon within and about the axis of the cylinder.

A further object is to provide a power-operated grinding apparatus which can be efficiently and reliably utilized for in-place grinding of the interior surface of a torpedo ejection cylinder.

These and other objects of the invention will become readily apparent from the ensuing descriptions when taken together with the drawings.

DESCRIPTION OF THE PREFERRED EMBODIMENT

Figure 1:
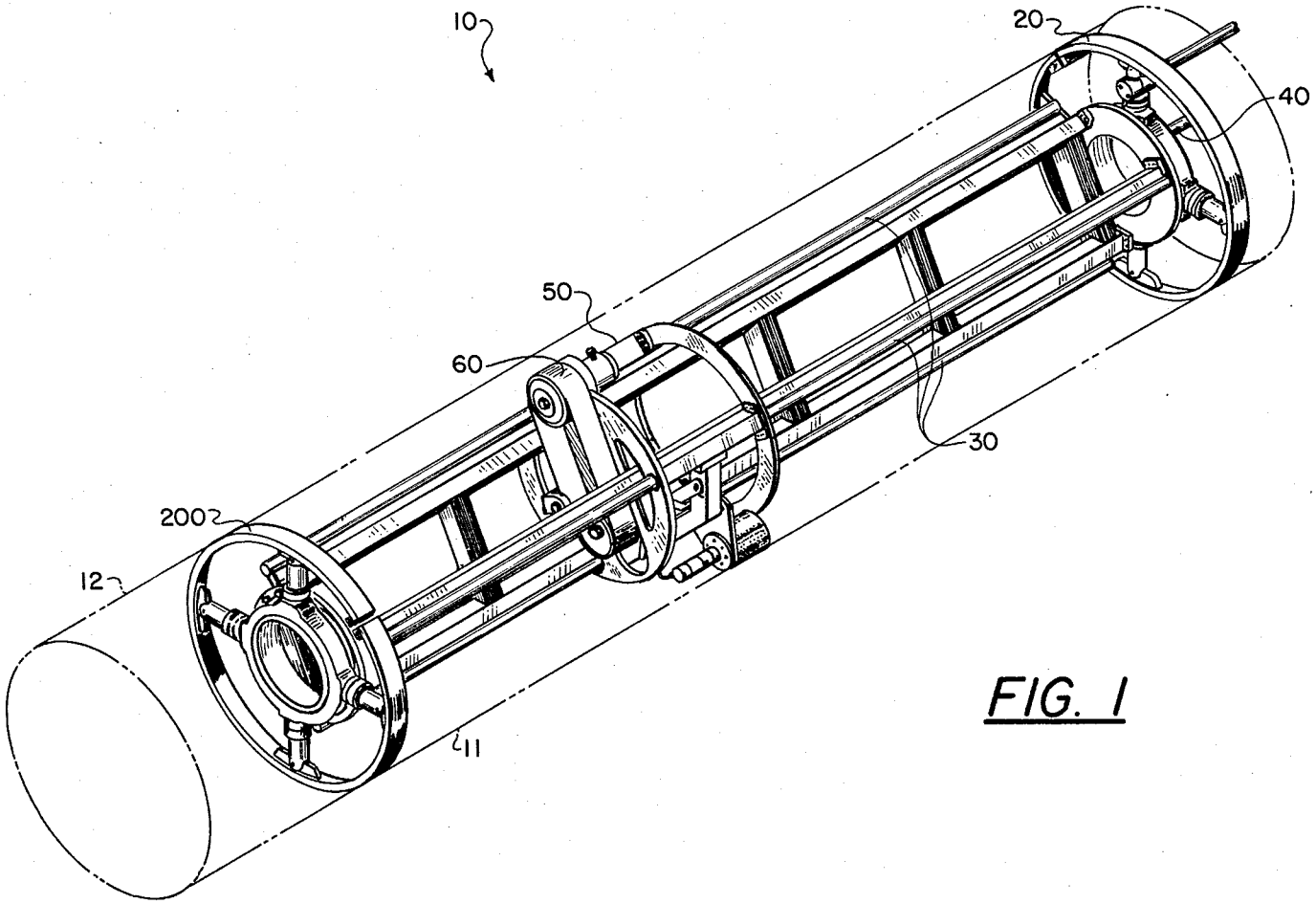
FIG. 1 is an isometric view of the invention.

Referring now to the drawings wherein like reference numerals designate like or similar parts throughout the several views, there is illustrated in FIG. 1 an in-place grinding apparatus 10 which is mounted in a cylinder 12 for machining the internal surface of the cylinder. The grinding apparatus 10 consists of six major assemblies: spiders 20 and 200, rail 30, drive 40, cage 50, and grinding 60.

In the preferred embodiment, the grinding apparatus 10 is mounted to the inner surface of a hollow cylinder 12 by means of a pair of circumferentially adjustable spider assemblies 20 and 200. A longitudinal, annulate rail assembly 30 is mounted on and between the spider assemblies with its longitudinal axis coaxial with the longitudinal axis of the cylinder 12. The rail assembly is slidably mounted on the spiders, in a manner described hereinbelow, so as to be rotatable about its longitudinal axis. The drive force necessary to rotate the rail assembly is provided by the drive assembly 40 which is mounted to the front spider assembly 20. A cage assembly 50 is movably mounted on the rail assembly so that it may be slid therealong in a direction parallel to the longitudinal axis of the rail assembly. A grinding assembly 60 is mounted on the cage assembly 50.

As the rail assembly 30 rotates within the cylinder, the cage assembly 50 with the grinding assembly 60 mounted thereto also rotates. The inner surface of the cylinder 12 is machined when the grinding assembly is activated and its grinding surface contacts the inner wall of the cylinder. An annulate section of the inner surface of the cylinder is machined by the grinding assembly with each rotation of the cage assembly. As the cage assembly advances along the longitudinal axis of the rail assembly, the grinding assembly machines a sequential series of contiguous annulate sections until the entire inner surface of the cylinder has been polished.

Figure 2B:
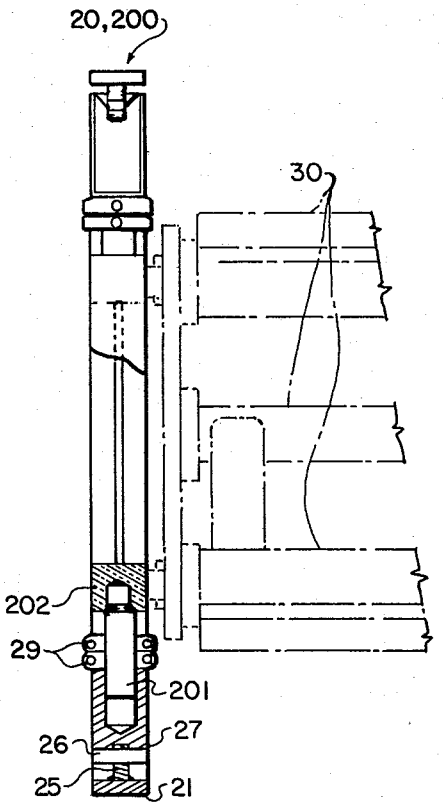
FIGS. 2A and 2B are end and side views, respectively, of a spider ring assembly used in the invention.
Figure 2A:
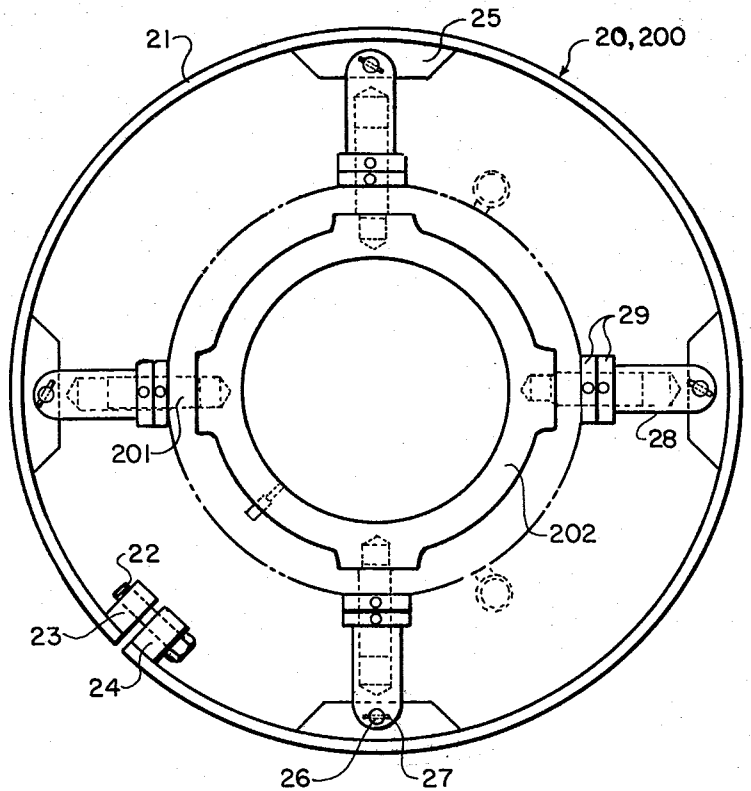
Figure 2D:
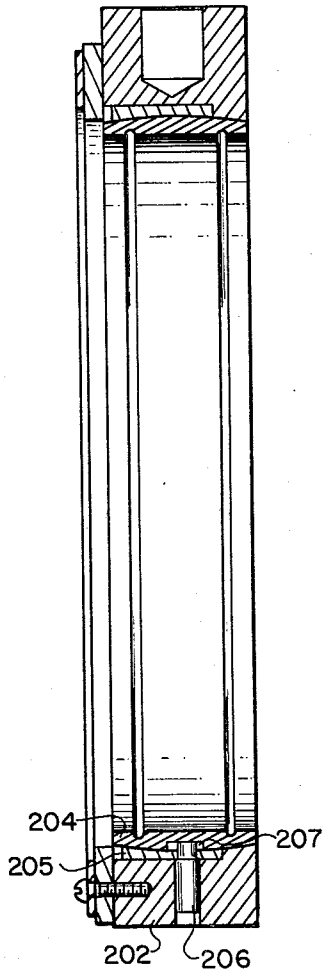
FIGS. 2C and 2D are end and side views, respectively, of a self-aligning spider ring assembly.

FIGS. 2A and 2B illustrate parts common to the front and rear spider assemblies of the invention. Each is a circular four legged spider designed to rotatably support the rail assembly and to be secured onto the inner surface of the cylinder to be machined. Two separate spider assemblies 20 and 200 are provided, front and rear, respectively.

Each spider assembly consists of a circumferentially adjustable ring-shoe 21 with a spreader bolt attachment comprising a spreader bolt 22 mounted between a threaded lug 23 and a doweled lug 24. Rotation of the spreader bolt 22 in one direction will cause the circumference of the ring shoe 21 to increase until the ring shoe is in flush, firm contact with the inner surface of the cylinder 12. Rotation of the spreader bolt 22 in the opposite direction will compress the ring shoe, allowing it to be removed. Four anchor lugs 25, spaced 90 degrees apart, are provided on the inner circumference of the ring shoe 21. To each anchor lug is attached an anchor pin 26 which provides a pivital mounting point for a jack housing 28. Each jack housing has a central longitudinal bore for accepting a jacking screw 201. The other end of each jacking screw fits into a recess provided in a bearing ring 202. The bearing ring is thereby fixedly held in concentric alignment with the ring shoe 21. Each jacking screw 201 has a threaded surface upon which is mounted a set of round nuts 29. The round nuts provide fine adjustment of the position of the center of the bearing ring 202 which, in turn, allows the axis of the bearing ring to be aligned with that of the cylinder.

Figure 2C:
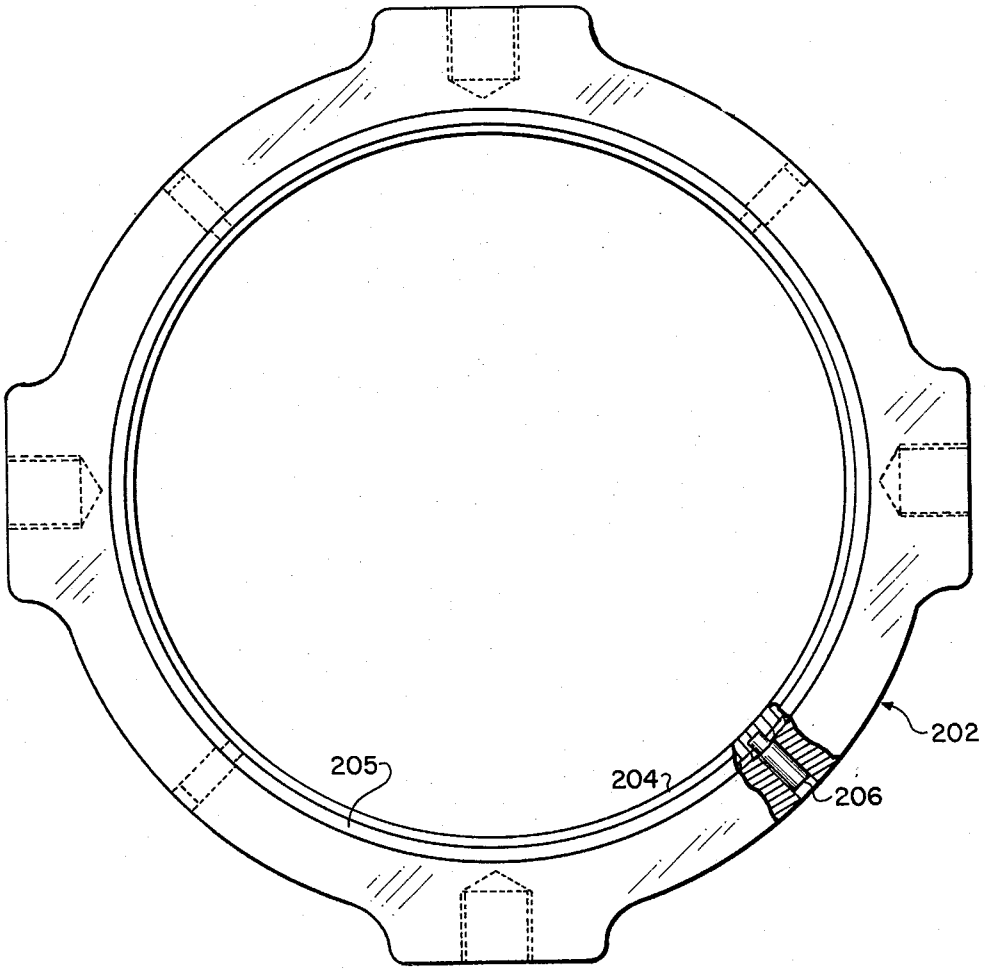

The front spider assembly 20 with the manually centerable bearing ring is positioned at the front end of the grinding apparatus 10. The rear spider 200, with a self-aligning bearing ring 202, is placed at the rear of the grinding apparatus. The self-aligning ring is illustrated in FIG. 2C. A centering ring 204 is inserted into the inner diameter of the bearing ring 202 and retained in place by a retainer ring 205 which is designed to fit into the inner circumferential surface of the bearing ring 202. The bearing ring 202 is provided with four threaded, radial holes spaced 90 degrees apart, each of which accepts a threaded setpoint dog screw 206. Each dog screw 206 extends through the bearing ring 202 and the retainer ring 205 into a notch 207 provided in the outer circumferential surface of the centering ring 204. The centering ring is prevented from sliding out of the bearing ring when a wall of the notch contacts the dog screw; yet the width of the notch allows the centering ring to move complimentarily to the radial plane of the bearing ring. The complimentary movement of the centering ring allows the centering ring to self align for perpendicularity with the longitudinal axes of the grinding machine and the cylinder. Self-aligning movement of the centering ring is induced by the hub of the rail assembly when the rail assembly is moved by manual alignment of the bearing ring in the other spider assembly.

The rail assembly 30, designed to slidably carry the cage assembly, comprises three rail units which join two hub assemblies. The rail units of the rail assembly are assembled to form the tips of an equilateral triangle with the loci of the intersecting point of the perpendicular bisectors of the sides forming the common longitudinal axis of the rail assembly which is coaxial with the axes of the front and rear spider subassemblies.

Figure 3C:
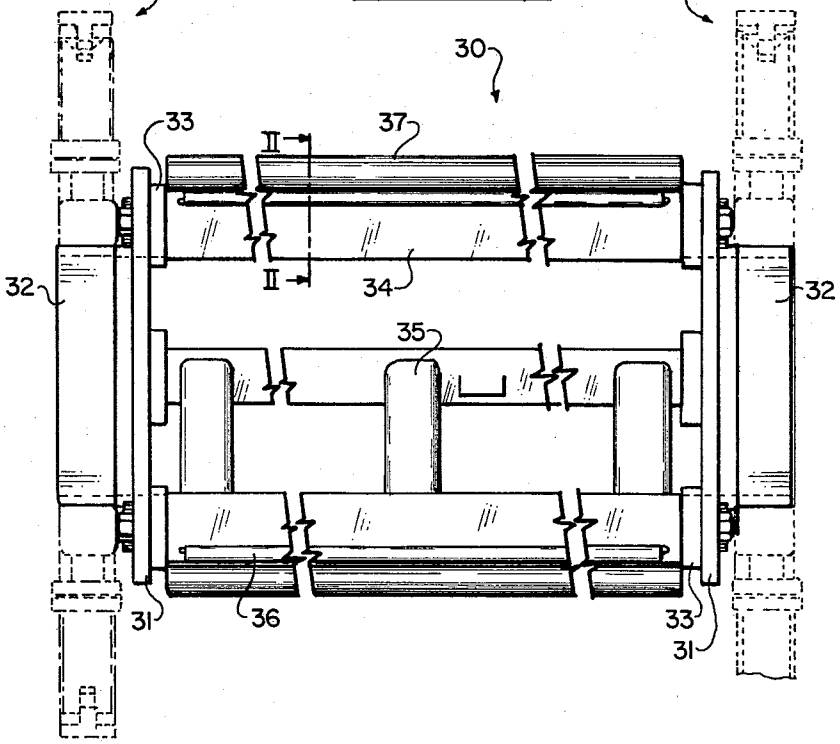
FIG. 3C is a side assembly view of the rail assembly used in the invention.
Figure 3D:
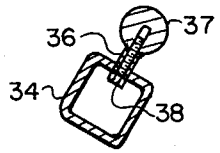
FIG. 3D is a sectional view taken along plane II—II in FIG. 3C.
Figure 3B:
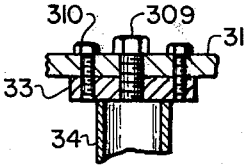
FIG. 3B is a sectional view taken along plane I—I in FIG. 3A.
Figure 3A:
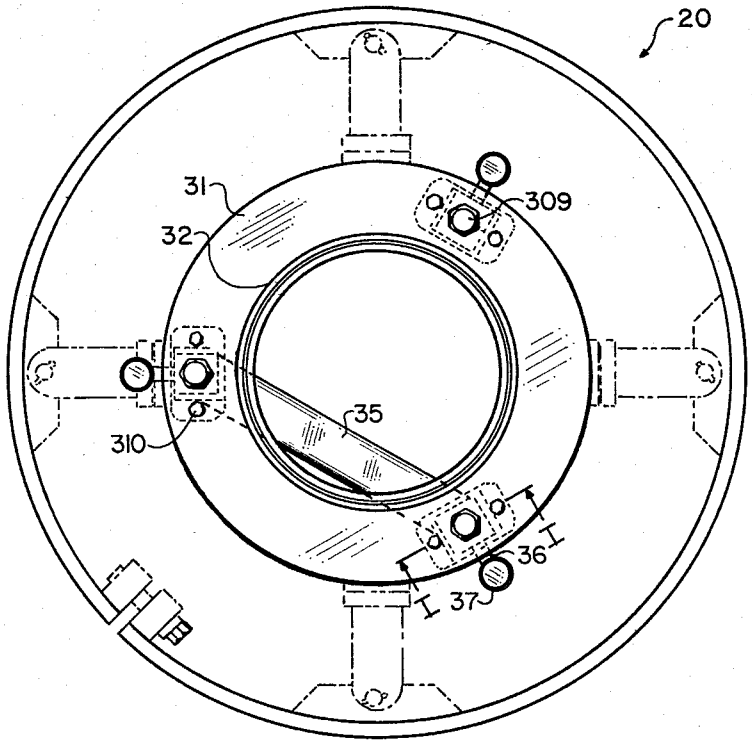
FIG. 3A is an end view of the rail assembly used in the invention.

As shown in FIGS. 3A, 3B, 3C and 3D, the rail assembly comprises two weldments, each consisting of a ring hub 32 and a hub flange 31. Each ring hub 32 is designed to engage a bearing ring 202 of a spider and to rotate therein. Each rail unit, comprising a rail bed 34, rail support 36, and rail 37 is attached to the hub flanges 31 by means of mounting pads 33, one of which is welded to each end of a rail bed 34. Each pad is secured to a flange by two screws 310 and one bolt 309. Each of the three rail beds is a square tube with a groove to accept a rail support 36 which is a long rectangular bar designed to accept and secure a rail 37. Each rail support is attached to a rail bed in a groove and welded in position to form a weldment. Each rail 37 is a round bar stock, precision machined and finished for straightness tolerance. Each rail is attached longitudinally to a rail support 36 and is secured thereto by means of socket head screws 38, one of which is shown in FIG. 3D. Bed stiffeners 35, equally spaced along two of the three rail beds 34, are aligned and welded into two rail beds 34.

Figures 4A, 4B, 4C:
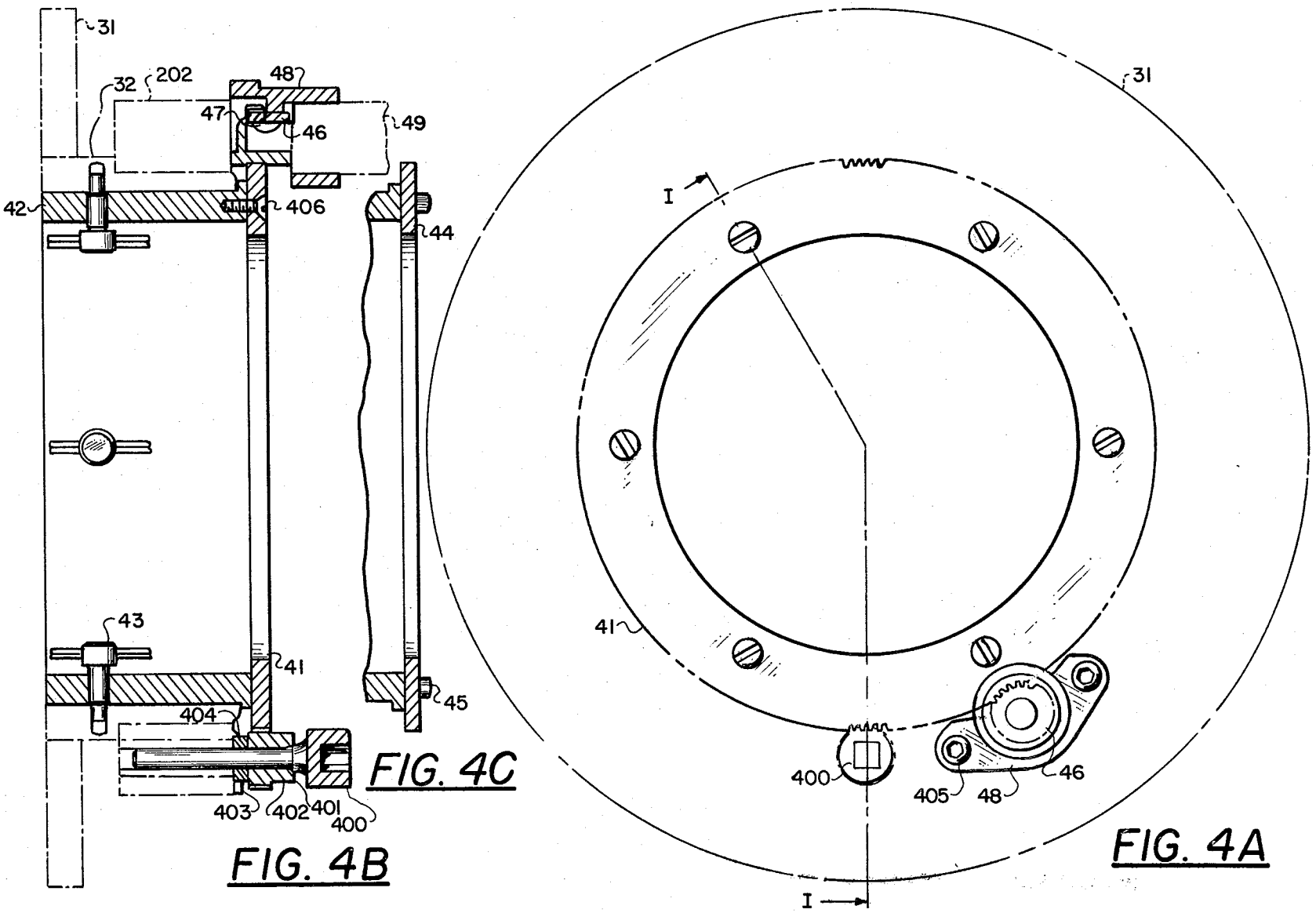
FIG. 4A is an end view of the rail assembly showing the drive unit used in the invention.
FIG. 4B is a sectional side view taken along plane I—I in FIG. 4A with the drive motor shown out of position.
FIG. 4C is a sectional side view of a retaining plate used in the invention.

In the preferred embodiment, the drive assembly which generates the rotational movement of the rail subassembly is mounted on the hub flange which engages the bearing ring in the manually adjustable front spider assembly 20. As shown in FIGS. 4A and 4B, a mounting ring 42 fits into the flanged ring hub 32 from the hub end and is secured thereto by means of lock-screws 43 which penetrate the mounting ring to engage threaded holes, in the ring hub 32. Four lock screws 43 are provided, three of which are shown in FIG. 4B. An annular ring gear 41 is provided with a radially recessed surface to fit onto the flanged end of the mounting ring 42. The ring gear 41 is attached to the mounting ring 42 by means of six flathead screws 406, one of which is shown in FIG. 4B. The ring gear 41 may have mounted over it a holding plate, not shown, with a large diametrical slot and a raised face area to fit into the ring of the ring gear. The primary function of the holding plate is to absorb the torsional force introduced by the acceleration of the drive motor.

A motor mount 48, shown out of position in FIG. 4B, accepts and secures the spindle of a drive motor 49. The motor mount 48 is attached and secured to the face of the bearing ring 202 with two socket head screws 405. A drive pinion gear 46 is attached to the spindle of the drive motor and the subassembly is inserted into the motor mount 48 and the drive pinion gear 46 is aligned and synchromeshed with the ring gear 41 in a locked-in position with a woodruff key 47.

A drive adaptor 400 with a pinion gear 401 is provided on the front spider 20 to permit manual rotation of the rail assembly during set-up to ensure synchromesh of the drive pinion gear 46 and the ring gear 41.

In FIG. 4C, a retaining plate 44 is shown. The retaining plate 44 is mounted on the ring hub at the rear of the rail assembly in the same manner as the ring gear 41 is mounted on the front and provides retention between the rear spider 200 and the rear of the rail assembly.

In the preferred embodiment, the drive motor is powered by compressed air and may be of the type manufactured by the ARO Corp., Brian, Ohio, under model number 7531A3. When compressed air is provided to the drive motor 49 its rotary motion is transferred to the ring gear 41 by way of the drive pinion gear 46 attached to the spindle of the motor. Rotation of the ring gear 41 causes the rail assembly to rotate by way of transmission of rotary motion through combination of the mounting ring 42 and the flanged hub ring 32 of the rail assembly.

Figure 5B:
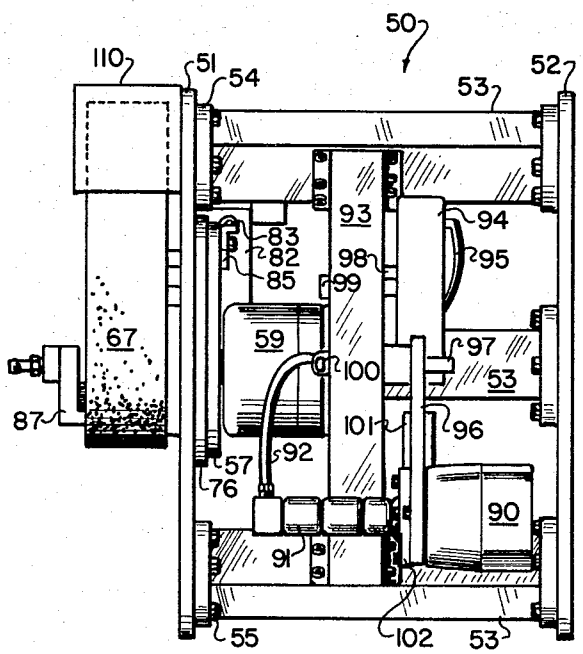
FIG. 5B is a side view of the cage assembly shown in FIG. 5A.
Figure 5A:
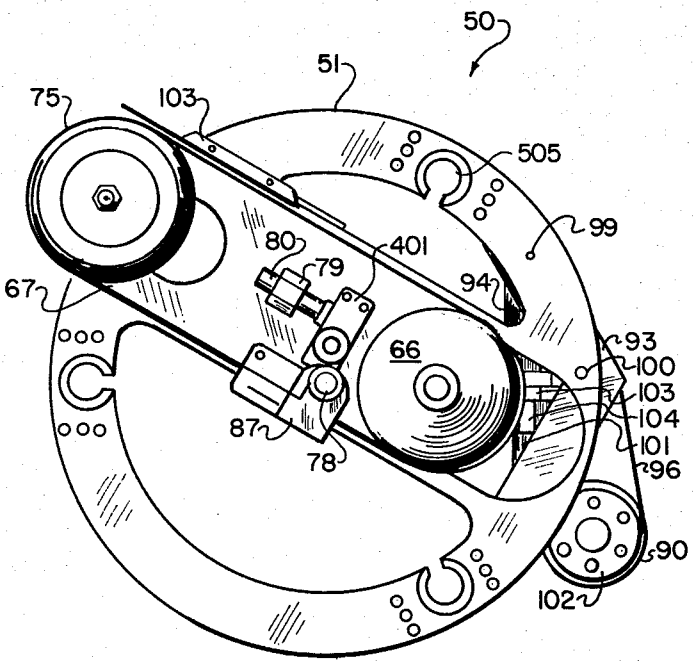
FIG. 5A is an end view of the cage assembly of the invention.

The cage assembly 50, illustrated in FIGS. 5*a* and 5*b*, functions as a unit with the spider 20 and 200 and guide rail 30 assemblies, with the cage travelling on the three rails provided on the rail assembly. While sliding longitudinally on the rails of the rail assembly, the cage assembly also rotates radially in conjunction with the rotational movement of the rail assembly. The longitudinal movement is performed manually in a manner described hereinbelow while the rotational movement is generated by the drive and rail assemblies as described hereinabove. The cage assembly is also the chassis and carriage of the grinding assembly.

Figure 6D:
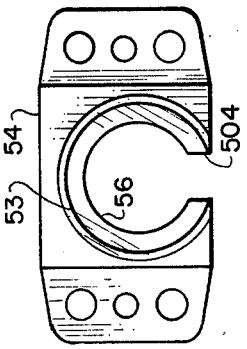
FIG. 6D is an enlarged end view of a flange used in the cage assembly.
Figure 6C:
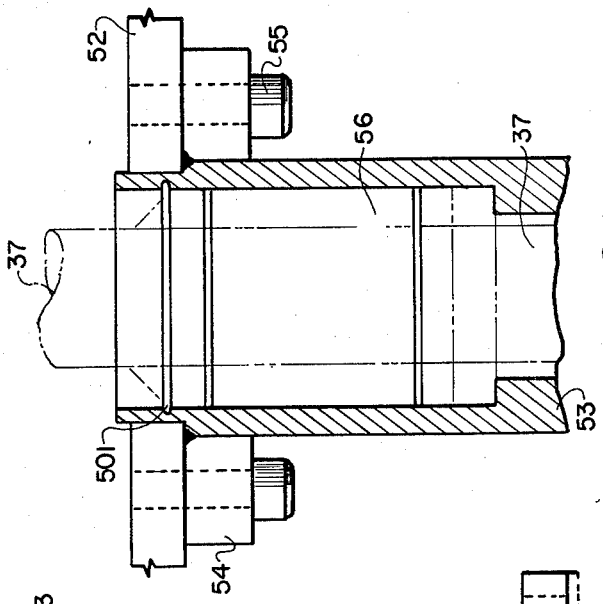
FIG. 6C is an enlarged sectional view of the means by which a cage assembly engages the rail assembly.
Figure 6B:
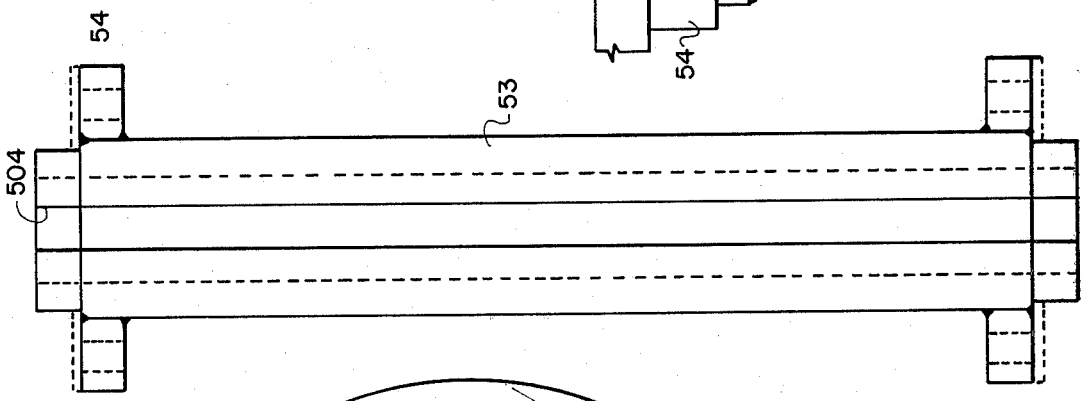
FIG. 6B is a top view of a spreader bar used in the cage assembly illustrated in FIG. 5A.
Figure 6A:
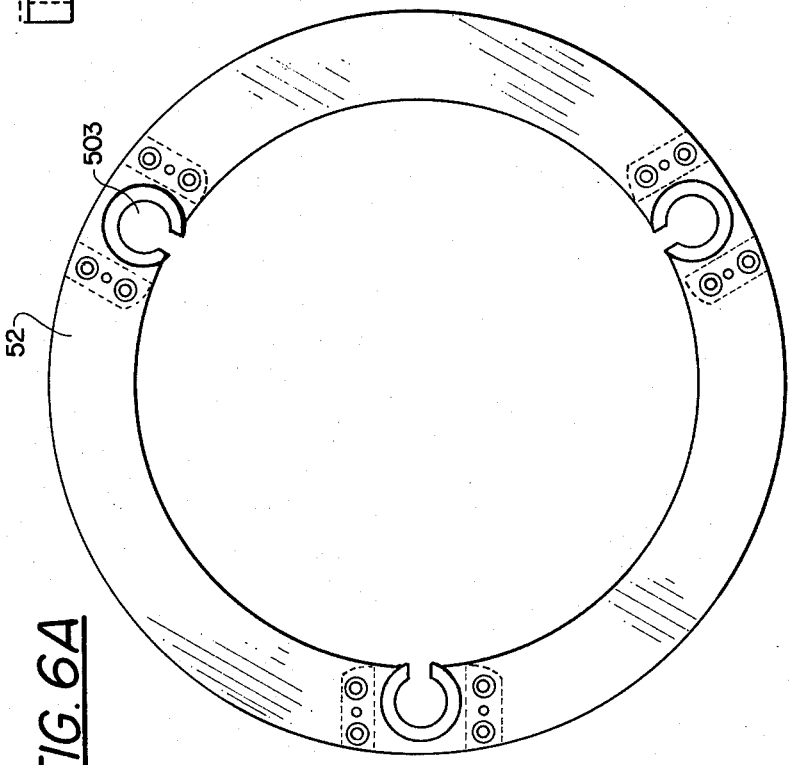
FIG. 6A is a front view of the cage ring of the cage assembly illustrated in FIG. 5A.

As shown in FIGS. 5B, 6A, 6B, 6C and 6D, the cage assembly consists of a cage plate 51 and a cage ring 52 which are joined together by three spreader bars 53. Each spreader bar 53 has welded at each end a flange 54 which is tapped and threaded with screw holes which align with screw holes on the cage plate and cage ring. The spreader bars are attached between the cage plate and cage ring by means of four socket head screws 55 per flange 54. When the cage assembly is assembled, the three sets of holes 503 on the cage ring 52 are aligned and coaxial with three other holes 505 provided on the cage plate 51. The central bore of each spreader bar 53 thus forms a continuous passage with holes 503 and 505 which, with the provision of a notch 504 which longitudinally cleaves each spreader bar, can accept a rail 37 with an attached rail support 36. As seen in FIG. 6C, a ball bushing 56 is seated in each end of a spreader bar and held in place with a retaining ring 501. The bushings slidably engage the rails of the rail assembly and permit the cage assembly to slide longitudinally on the rail assembly between the spiders. The ball bushings may be of the type manufactured by Thompson Industries, Manhasset, N.Y., under the series designation OPN, or their equivalent.

As illustrated in FIG. 1, when the cage assembly 50 is placed on the rail assembly, it is oriented to position the cage ring 52 closest to the front spider assembly 20, where the drive assembly 40 is attached.

With reference now to FIGS. 5A, 5B and 7A through D, the structure and operation of the grinding assembly can be comprehended. The grinding assembly comprises a belt type, pneumatically powered grinding apparatus as well as diametrical adjustment and belt tension mechanisms. These elements are designed to utilize a number of common parts with distinctive functions and with the capability of simultaneous operations.

Figures 7A, 7B, 7C, 7D, 7E:
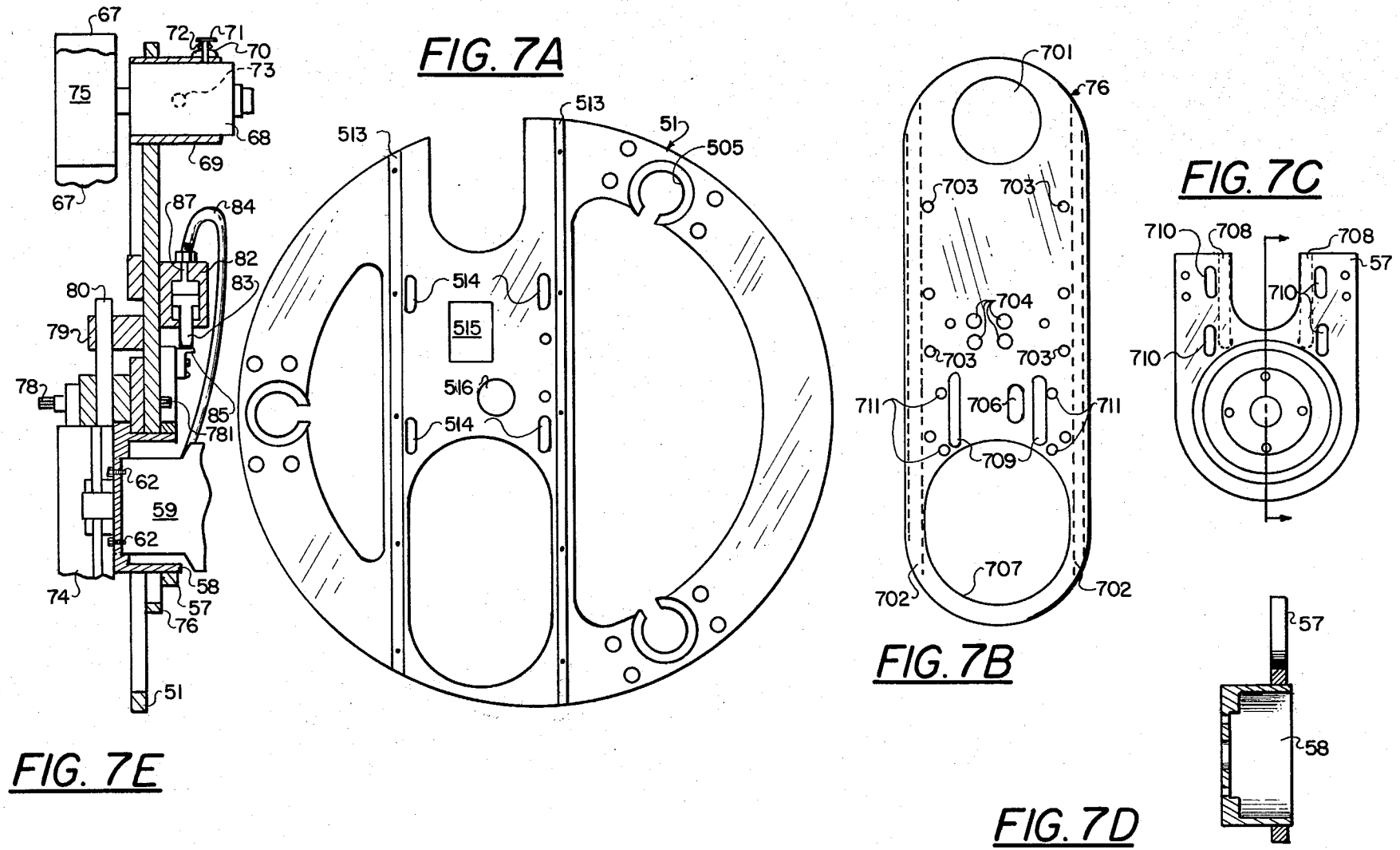
FIGS. 7A, 7B, 7C and 7D illustrate parts common to the cage and grinding assemblies of the invention.
FIG. 7E is a side sectional view of a part of a cage assembly illustrating the diametric adjustment and belt tension adjustment subassemblies, respectively, of the grinding assembly.

The grinding apparatus includes a pneumatic motor 59 (model number 8395 by ARO or equivalent) mounted in a motor mounting ring 58 which is welded to a motor tension plate 57. The motor is held in place by four socket head screws 62, two of which are shown in FIG. 7E. The weldment consisting of the motor mounting ring 58 and the tension flange 57, shown in FIGS. 7C and 7D, with the motor attached thereto is slidably mounted on an adjustment plate 76 which, in turn, is slidably mounted on the cage plate 51. A pulley 66 is rotatably coupled to the motor 59.

A free spindle 68 is mounted in a cylindrical housing 69 which has two pivot bosses 73, one of which is shown in FIG. 7E, in the same radial plane, spaced at 180 degrees apart, and approximately at the midsection of the cylinder 69. A threaded boss 70 is spaced 90 degrees from either pivot boss and near the end of the cylinder 69. The pivot bosses 73 provide openings through which shoulder bolts, not shown, can be inserted to secure the free spindle housing 69. The threaded boss accepts a threaded tension knob 71 with a spring 72 for manual adjustment of grinding belt tension. The spindle housing is inserted into a hole 701 at one end of the adjustment plate 76 to which the housing is welded. A contact wheel 75 is coupled to the free spindle 68 which is held in the spindle housing. A sanding belt 67 is then placed around the contact wheel 75 and the pulley 66 and driven by the rotation of the pulley 66 when it is driven by the grinding motor 59.

Diametrical adjustment of the setting of the grinding belt 67 is accomplished by movement of the adjustment plate 76 with respect to the cage plate 51. As illustrated in FIGS. 7A and 7B, the adjustment plate 76 slides on two keys, not shown, attached and secured to the cage plate 51 in the key slots 513 provided thereon. The adjustment plate 76 is slidably mated to the cage plate keys on the key ways 702 provided on the adjustment plate. The adjustment plate is held to the cage plate by means of four shoulder bolts, not shown, which extend through the slotted holes 514 on the cage plate 51 and screw into the tapped, threaded holes 703 on the adjustment plate.

The slidable relative movement of the adjustment plate 76 and the cage plate 51 is generated by a gear unit. The gear unit consists of a worm gear 78, linkage nut 79, and a worm wheel shaft 80. The worm gear 78 is the driver, the worm wheel shaft 80 is the intermediate, and the linkage nut 79 is the driven gear.

The linkage nut 79 is fixedly attached to the adjustment plate 76 by means of four flathead socket screws, not shown, which are inserted through holes 704 and screw into the bottom of the linkage nut 79. When the adjustment plate 76 is mounted on the cage plate 51 in the manner described hereinabove, the linkage nut 79 extends through the rectangular hole 515 in the cage plate.

The worm gear assembly, illustrated in FIGS. 5A and 7E, consists of the worm gear 78 and the coupled output shaft 80 which are encased in an enclosure 801. The worm gear unit is attached to the cage plate 51. The worm gear 78 can be engaged by a driver, not shown, at either end. One end 781 of the worm gear extends through the circular hole 516 provided in the cage plate 51. Access to this engagement end of the worm gear 78 is provided through the adjustment plate 76 by means of the elongated slot 706.

With the linkage nut 79 attached to the adjustment plate 76 and the worm gear unit attached and secured to the cage plate 51, the adjustment plate is enabled to slidably move by means of the mechanical power introduced by the worm gear unit. The linkage nut 79 functions in relation with the rotational movement of the worm wheel shaft 80 which is threaded to engage the internal threads of the linkage nut 79. The mechanical power generated by rotation of the worm gear is transmitted by way of the output shaft 80 to the linkage nut which, being fixedly attached to the adjustment plate, causes the adjustment plate to slide relative to the cage plate on the keys attached to the cage plate.

Since the radius of the cage plate 51, and of the full cage assembly, is fixed relative to the radius of the cylinder in which the grinding apparatus is mounted, the movement of the adjustment plate relative to the cage plate and the cage assembly will adjust the position of the contact wheel 75 and the grinding belt 67 in the radial plane of the cylinder, thus providing adjustability in the diameter of the grinding operation.

The tension of the grinding belt is proportional to the distance between the pulley 66 and the contact wheel 75 over which the belt is placed. Adjustment of the tension of the belt is accomplished by moving the motor tension plate 57 with the combination of pulley 66 and grinding motor 59 relative to the adjustment plate 76.

The motor tension plate 57 is mounted on the adjustment plate 76 with the mounting ring 58 placed in the oblong hole 707 provided in the adjustment plate 76. A pair of key slots 709 are provided on the surface of the adjustment plate 76 and a pair of keys, not shown, are attached therein. When the motor tension plate 57 is placed on the adjustment plate 76, the key ways 708 on the side of the tension plate away from the viewer in FIG. 7C engage the keys and allow the tension plate to slide on the adjustment plate. The tension plate is held to the adjustment plate by means of four shoulder bolts, not shown, which extend through oblong holes 710 in the tension plate and screw into the threaded holes 711 provided on the adjustment plate.

The movement of the motor tension plate which sets the tension of the grinding belt is generated by a pneumatic dual piston ram and a pair of tabs mounted on the motor tension plate. As shown in FIGS. 5B and 7E, the piston ram consists of a housing 82 which contains two pistons, 83, one of which is shown in FIG. 7E. The pneumatic housing 82 is secured to the adjustment plate by a pair of flathead screws, not shown. Two tabs 85 are secured to the motor tension plate 57, one tab on each leg of the plate, by socket screws, not shown. The pneumatic ram is placed so that each piston 83 contacts the raised end of a tab 85. When air is supplied through the pneumatic hose 84, each piston 83 is forced outward against a tab 85, which moves the motor tension plate with the attached motor 59 and pulley 66 away from the contact wheel 75, thereby tensioning the sanding belt 67.

The motor tension plate 57 is forked at one end as shown in FIG. 7C so that when it, the adjustment plate 76, and the cage plate 52 are assembled together, access to the engagement end 781 of the worm gear 78 will be available.

With reference now to FIGS. 5A and 5B, a modification of the cage assembly of the preferred embodiment can be understood. A combination auxiliary power unit and stabilizer mechanism 90 is mounted on the cage assembly to provide drive power to supplement that provided by the drive assembly 40 described hereinabove, and to balance the centrifugal force exerted on the cage assembly when the grinding belt 67 is in operation.

The stabilizer unit consists of a large rotatable roller 90 coupled to an air driven motor 91 which is driven by air supplied through air hose 92. The stabilizer and attached motor are mounted on a movable pivot arm 96 by a mounting plate 102. The pivot arm, in turn, is pivotally attached to a pivot support bar 93 which is mounted between two spreader arms 53. The pivot arm 96 is movable attached to the pivot support 93 by means of the combination of pivot 97 and nut 100. Radial movement of the stabilizer unit is effected by a pneumatic cylinder 94 which is activated by a supply of air provided through pneumatic hose 95. The output shaft 104 of the cylinder 94 is attached to the pivot support 93 by means of a pivot arm 98 which is pivotally attached to the support by a shoulder bolt and washer combination 99. The cylinder shaft is coupled to move the stabilizer 90 outward to contact the wall of the cylinder by means of a yoke 101, a mounting nut 103, and a threaded shaft 104. The yoke 101 is pivotally attached to a flange, not shown, on the back of the pivot arm 96. When the air cylinder 94 is activated by a supply of air, the shaft 104 is forced out which causes the stabilizer to pivot on the pivot arm 96 outwardly to contact the wall of the cylinder. The pivotal attachment of the air cylinder 94 allows it to move with the stabilizer unit to keep the two mechanisms in alignment.

Figures 8A, 8B, 8C, 8D:
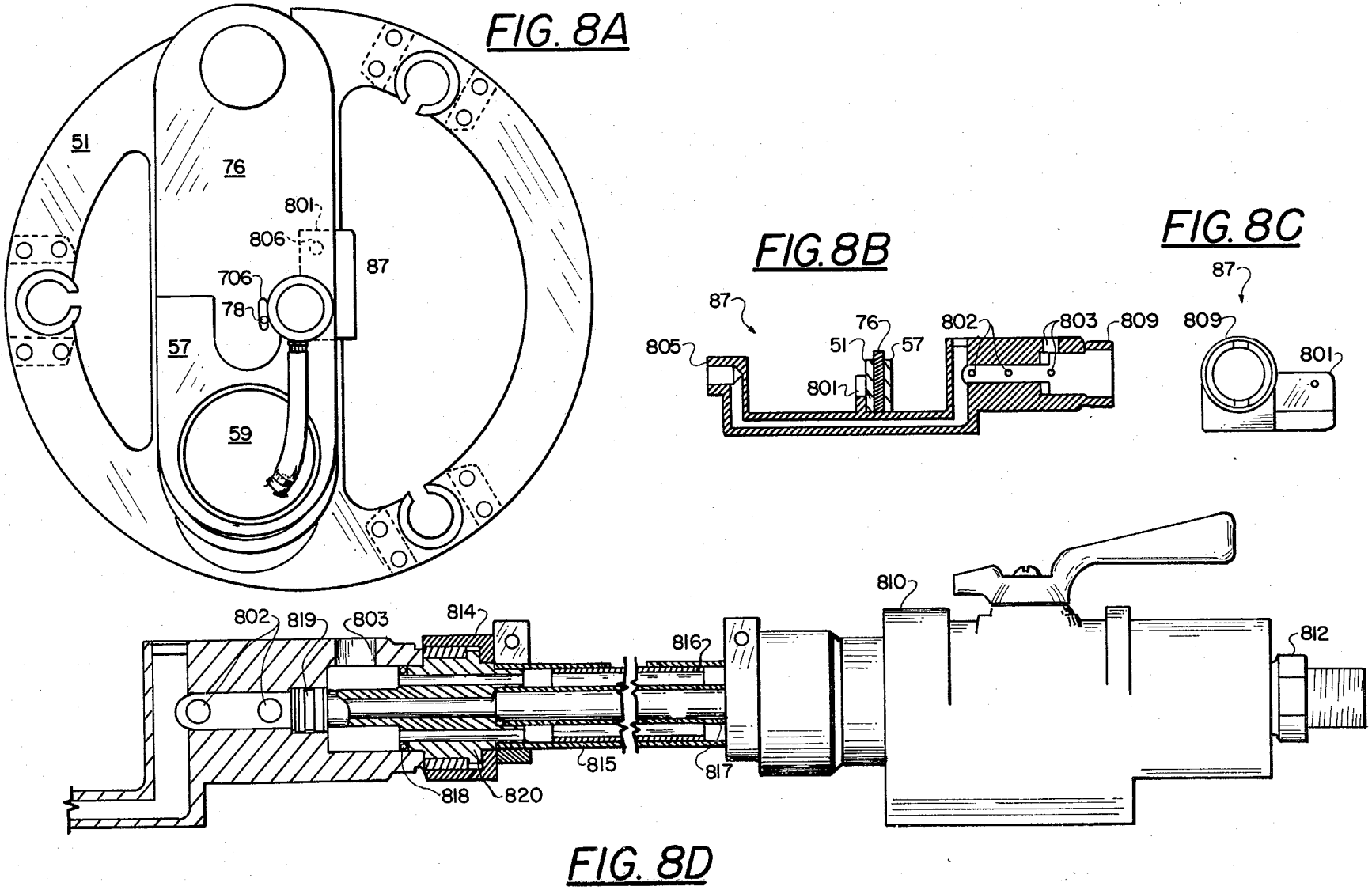
FIG. 8A is an end view of part of the cage assembly showing attachment points for air supply and remote control of the diametric adjustment of the grinding belt.
FIG. 8B is a side sectional view of the air manifold and valve subassembly used in the invention.
FIG. 8C is a front view of the air manifold.
FIG. 8D is a side sectional view of an air supply assembly including the air manifold.

An apparatus for supplying the air necessary to operate the grinding motor 59, the piston assembly 82, the stabilizer motor 91, and the air cylinder 94 as shown in FIGS. 8A through 8D. An air manifold 87 is attached to the cage plate 51 by a pair of socket head screws 806, one of which is shown in FIG. 8A, which attach in a pair of threaded holes, not shown, in the flange 801 of the air manifold 87. When the manifold is mounted, the neck portion 809 is coaxial with the cage assembly 50 and the grinding machine 10. The air manifold 87 has an interior passageway to confine the flow of air to which a first pair of threaded openings 802 and a second pair of threaded openings 803 penetrate from the surface of the manifold. The neck portion 809 is threaded at the end of its exterior surface and has a central opening which connects with the interior passageway of the manifold. The interior passage extends on the other end of the manifold to opening 805 which is permanently plugged in the present embodiment.

The assembly for supplying air to the manifold from a remote position is illustrated in FIG. 8D. The air manifold 87 is coupled by nut 814 to a multiple air passageway assembly enclosed by a circular sleeve 815. Concentric with and within the sleeve is a first tube 816 which provides an air passageway through a manifold subassembly 820 to the two threaded apertures 803. A central tube 817, concentric with the outer tube 816 and the sleeve 815 provides a second air passageway, separate from the first, through the manifold subassembly 820 to the two threaded apertures 802. O-rings 818 and 819 provide airtight seals to maintain the pneumatic separation of the first and second passageways. A three-way selector valve 810 provides three settings which control the flow of air to the manifold 87. A first setting closes all passageways; a second setting provides air through the central passageway in tube 817 to the threaded holes 802; a third setting provides compressed air through both passageways to threaded holes 802 and 803.

In the preferred embodiment the piston assembly 82 and the grinding motor 59 are connected to the threaded holes 802 which open to the central air passageway, and the air cylinder 94 and stabilizer motor 91 are connected to the threaded holes 803 which penetrate to the outer air passageway. When the central air passageway is provided with air at the second setting of the selector valve 810 the grinding belt is placed in tension and the grinding motor is started. When the third valve position is selected, providing air to both passageways, the stabilizer motor 91 is cocked and activated.

FIG. 8D also shows a pneumatically sealed rotary union 812 which enables the selector valve, the air manifold, and all of the coupling equipment therebetween to rotate together with the cage and rail assemblies. When the cage and rail assemblies rotate, the air supply apparatus rotates on its axis due to the centering of the neck portion 809 of the manifold 87 on the cage plate 51. The other side of the rotary union is kept stationary in the preferred embodiment for reasons discussed hereinbelow.

Figure 9:
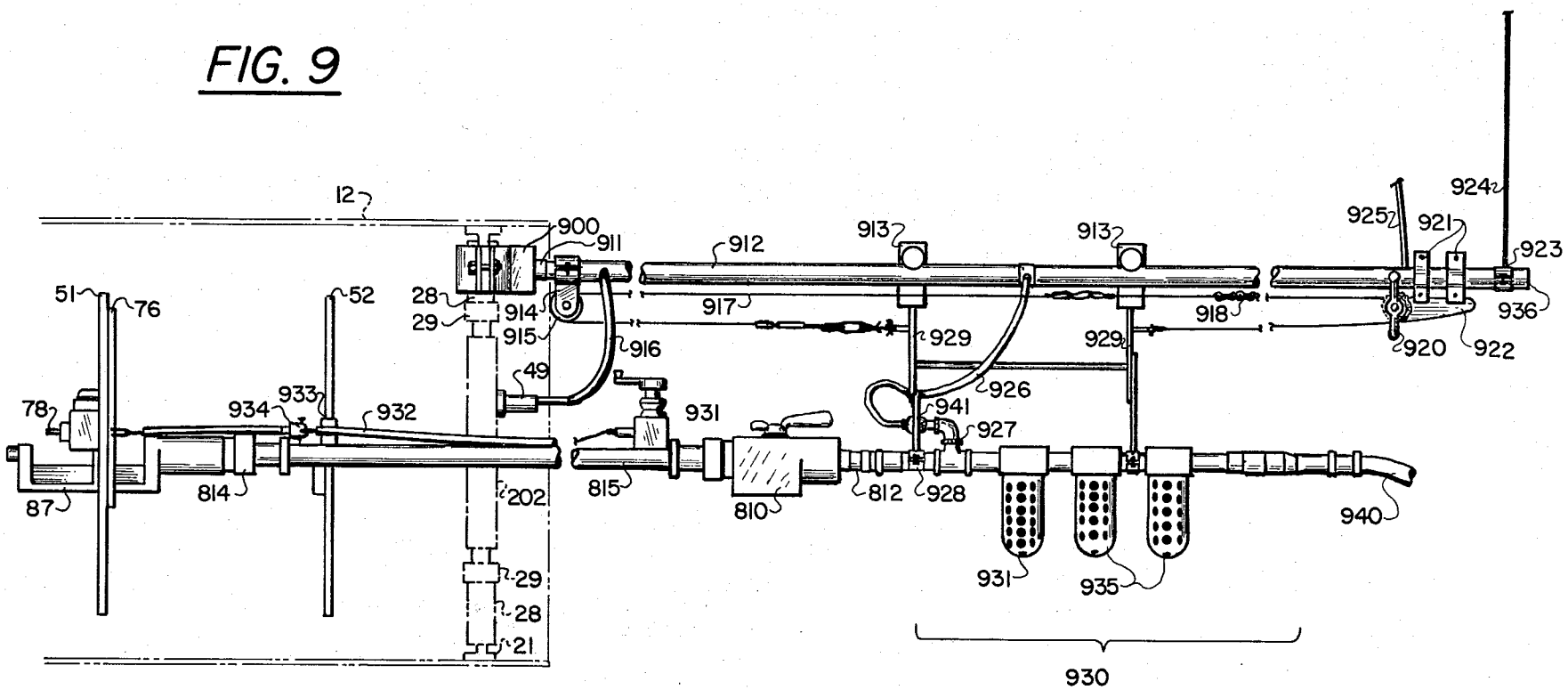
FIG. 9 is a side view of the feed assembly used in the invention.

The axial advancement of the cage assembly within the work piece cylinder can be understood with reference to the mechanism illustrated in FIG. 9. The cage assembly is advanced when force is applied along the axis of the sleeve 815 through which air is supplied to the manifold 87 attached to the cage plate 51. As illustrated in FIG. 9, the sleeve 815 and selector valve 810 are joined by a rotary joint 812 to a compressed air mechanism 930 comprising a pair of air filters 935 and an oil filter 931 which are fed from a source of compressed air, not shown, through pneumatic fitting 940. The compressed air feed mechanism 930 is suspended from a rail pipe 912 by a pair of hangers 929, each of which is attached to a roller bracket assembly 913. The roller bracket assemblies utilize the pipe 912 as a rail along which they carry the compressed air feed assembly 930. A chain assembly 918 is connected to one hanger and is operably engaged by a rotary sprocket assembly 920 mounted on a holder 922. The holder 922 is fixed to the rail 913 by pipe brackets 921. The other end of the chain 918 is connected to a wire rope 917. The wire rope 917 is engaged around pulley 915 to the other hanger 929. The pulley 915 is fixedly positioned on the rail pipe 912 by the pipe bracket 914. Rotation of the rotary sprocket assembly 920 will cause the connected chain 918 and wire rope 917 to pull hangers 929 and suspended compressed air feed assembly 930 in a direction parallel to the axis of the rail pipe 912. This movement is translated by way of pipe 815 to the cage assembly and causes the cage assembly to slide along the rail assembly during the grinding operation. In the preferred embodiment, the rotary sprocket assembly 920 is coupled to a motor, not shown, which ensures that the advancement of the cage assembly during operation will be continuous and smooth.

The rail assembly 912 provides an axial hermetic air passage for providing compressed air to drive the drive motor 49. Air is provided to the drive motor through the combination of the T assembly 927 connected to the air hose 926 which feeds the air passage of the rail pipe 912 which, in turn, is tapped by air hose 916 attached to the compressed air input for the drive motor 49.

The rail pipe 912 is fixed in position by anchoring it at both ends. At one end, bracket 923 provides an attachment point on the rail pipe 912 for hanger 924 which may be suspended from any fixed point, for example, the workshop ceiling. At its other end, rail pipe 912 is attached to a jack housing 28 of the front manually adjustable spider assembly 20 by means of clamp 900. A hermetic ball joint 911 seals that end of the rail pipe 912 which providing a swivel point which will compensate for any minor relative motion between the rail pipe 912 and the front spider assembly. The other end of the rail pipe 912 is sealed by end plug 936.

The diametrical adjustment of the grinding assembly can be made outside of the cylinder before or during the grinding operation by means of a retrod assembly comprising a hand cranked, right angled gear box 931 and a flexible, rotatable rod assembly 932 coupled to the gear box 931 and anchored on the cage assembly by brackets 933 and 934. At the cage plate 51 the retrod assembly is connected to the worm gear end 781 through the elongated slot 706 in the adjustment plate 76.

In operation, the grinding apparatus of the invention is placed inside of cylinder 12 to be machined where it is retained in position by turning the spreader bolts 22 to bring the ring shoes 21 into a close holding contact with the inner surface of the cylinder 12. The grinding apparatus is oriented with the manually adjustable spider assembly 20, termed the front spider, placed at the end of the cylinder where the operator is located.

The cage assembly is pulled forward on the rail assembly to the front spider assembly, where the diameter of the grinding operation is set by manual operation of the right angle gear box. Next, the grinder belt is placed in tension and the grinding motor is turned on by turning the selector valve 810 to the second position.

The grinding operation is begun by turning a drive motor control valve 941 to the on position which commences rotation of the rail and cage assemblies. At the same time, the selector valve 810 is turned to the third position which activates the stabilizer motor, and the diametrical adjustment of the grinding belt is set to bring the belt in contact with the inner wall of the cylinder. Each complete rotation of the rail and cage assemblies will cause one annular segment of the interior surface of the cylinder 12 to be machined by the action of the grinding belt. The cage assembly is advanced to machine successive segments of the interior surface of the cylinder when the motor which drives the rotary sprocket assembly 920 is activated. In this manner, the entire interior surface of the cylinder is finished.

Obviously, many modifications and variations of the present invention are possible in light of the above teachings, and, it is therefore to be understood that the invention may be practiced otherwise than as specifically described.

What is claimed is:

1. A grinding apparatus for in-place machining of the interior surface of a hollow cylinder, comprising:

two diametrically adjustable spider ring assemblies concentrically attachable to the inner surface of the cylinder in a spaced relationship;

a longitudinal annulate rail assembly having opposite ends, each end rotatably mounted in a respective spider so that the rail assembly can be coaxially positioned in the cylinder and rotated;

drive means mounted on at least one spider for rotating the rail assembly;

a cage assembly mounted on the rail assembly for slidable movement therealong;

means for incrementally sliding the cage assembly along the rail assembly;

a grinding assembly mounted on the cage assembly;

the spider assembly including:

a circumferentially adjustable attachment ring;

an annular bearing ring assembly; and a plurality of spreaders connecting the attachment ring and the bearing ring, each spreader being adjustable in length; and the rail assembly including:

a pair of flanged, annular ring hubs for slidably engaging the bearing rings of the spiders; and a plurality of rails attached to and extending between the hubs.

2. A grinding apparatus as in claim 1 wherein the drive means comprises:

a drive motor mounted on a bearing ring assembly, the motor having an output gear assembly; and an annular ring gear assembly attached to a ring hole flange and in operative engagement with the output gear assembly.

3. A grinding apparatus as in claim 2 wherein the cage assembly comprises:

a circular plate;

a cage ring;

a plurality of spreader bars attached between the plate and cage ring; and a plurality of bushings mounted in each spreader bar to slidably engage a rail.

4. A grinding apparatus as in claim 3 wherein the grinding assembly comprises:

a belt grinder comprising a spindle and a belt;

a motor which engages the grinder belt for driving the belt grinder; and means for mounting the motor and belt grinder on the circular plate cage, the mounting providing adjustment of the belt grinder in the radial plane of the cylinder and adjustment of the tension of the belt.

5. A grinding apparatus as in claim 4 wherein the means for moving the cage assembly comprises:

a first rigid tube attached at one end to a bearing ring assembly and fixedly positioned at its other end;

a second rigid tube parallel to the first and extending through the center of the ring hub engaged to the bearing ring to which the first tube is attached, the second tube attached at one end to the cage assembly and slidably suspended substantially at its other end from the first tube; and means co-operating with the first tube for incrementally moving the second rigid tube.

6. A grinding apparatus as in claim 5 wherein the belt grinder mounting means comprises:

an adjustment plate to which the grinder spindle is attached, the adjustment plate having first and second surface and being slidably mounted on its first surface to the circular plate to be movable in the radial plane of the cylinder;

means for moving the adjustment plate relative to the circular plate;

a tension plate to which the motor is mounted, the tension plate slidably mounted on the second surface of the adjustment plate to be moveable thereon; and means for moving the tension plate relative to the adjustment plate.

* * * * *